US007386264B2

(12) United States Patent
Blair et al.

(10) Patent No.: US 7,386,264 B2
(45) Date of Patent: Jun. 10, 2008

(54) FUSING SYSTEM INCLUDING A BACKUP BELT ASSEMBLY

(75) Inventors: Bryan M. Blair, Lexington, KY (US); James D. Gilmore, Lexington, KY (US); Miranda E. Oaks, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/234,362

(22) Filed: Sep. 23, 2005

(65) Prior Publication Data

US 2007/0071518 A1 Mar. 29, 2007

(51) Int. Cl.
*G03G 15/20* (2006.01)

(52) U.S. Cl. ..... 399/329

(58) Field of Classification Search ..... 399/329
See application file for complete search history.

(56) References Cited

U.S. PATENT DOCUMENTS 4,972,206 A 11/1990 Matoushek
5,053,829 A 10/1991 Field et al.
5,291,255 A 3/1994 Britto et al.
5,345,300 A 9/1994 Uehara et al.
5,359,401 A 10/1994 Uehara et al.
5,408,302 A 4/1995 Manzer et al.
5,572,290 A 11/1996 Ueno et al.
5,614,999 A * 3/1997 Kanesawa et al. ..... 399/329
5,621,512 A 4/1997 Uehara et al.
5,648,841 A 7/1997 Yasuda et al.
5,666,624 A 9/1997 Kanesawa et al.
5,715,508 A 2/1998 Berkers et al.
5,729,812 A 3/1998 Moser
5,737,679 A * 4/1998 Uehara et al. ..... 399/329
5,832,353 A 11/1998 Sano
5,866,875 A 2/1999 Okabayashi
5,873,020 A 2/1999 Matsuura et al.
5,887,235 A * 3/1999 Wayman et al. ..... 399/329
5,890,047 A 3/1999 Moser
5,960,243 A 9/1999 Daigo et al.
5,999,788 A * 12/1999 Kanesawa et al. ..... 399/329

(Continued)

FOREIGN PATENT DOCUMENTS

JP 4936342 4/1974

(Continued)

OTHER PUBLICATIONS

L. I. Britto, A.D. Mead, A Murthy and W.F. Voit, Jr.; Fusing System for a Color Printer or Copier, IBM Technical Disclosure Bulletin, vol. 33, No. 12, May 1991.

*Primary Examiner*—David M. Gray
*Assistant Examiner*—Bryan Ready
(74) *Attorney, Agent, or Firm*—Stevens & Showalter, LLP

(57) ABSTRACT

In accordance with a first aspect of the present invention, a system is provided for fusing an unfixed toner image to a substrate comprising a rotatable hot fusing roll and a backup belt assembly. The belt assembly may comprise a backup belt and a housing structure including a nip forming pressure roll. The backup belt may be wrapped about the housing structure including the nip forming pressure roll. Preferably, the pressure roll applies a force to the belt so as to form the sole nip region between the rotatable fusing roll and the backup belt.

20 Claims, 5 Drawing Sheets

U.S. PATENT DOCUMENTS

| | | | | |
|---|---|---|---|---|
| 6,055,390 | A | 4/2000 | Kurotaka et al. | |
| 6,122,480 | A | 9/2000 | Hwang | |
| 6,173,152 | B1 | 1/2001 | Schlueter, Jr. et al. | |
| 6,198,888 | B1 | 3/2001 | Kurotaka et al. | |
| 6,212,356 | B1 | 4/2001 | Ishikawa et al. | |
| 6,272,310 | B1 | 8/2001 | Blair et al. | |
| 6,298,216 | B1 | 10/2001 | McMindes et al. | |
| 6,321,061 | B1 | 11/2001 | Sonobe et al. | |
| 6,430,381 | B1 | 8/2002 | Kopp | |
| 6,440,048 | B1 | 8/2002 | Bleil et al. | |
| 6,490,429 | B2 | 12/2002 | Okayasu et al. | |
| 6,496,680 | B2 | 12/2002 | Fujimoto et al. | |
| 6,501,935 | B2 | 12/2002 | Hirai et al. | |
| 6,562,539 | B1 | 5/2003 | Chatow et al. | |
| 6,567,640 | B2 | 5/2003 | Ishikawa | |
| 6,618,573 | B2 | 9/2003 | Ishikawa et al. | |
| 6,754,457 | B2 | 6/2004 | Ciaschi et al. | |
| 6,757,514 | B2 | 6/2004 | Berkes et al. | |
| 6,785,501 | B2 | 8/2004 | Honawa et al. | |
| 6,799,000 | B2 | 9/2004 | Aslam et al. | |
| 6,826,382 | B2 | 11/2004 | Sanpei et al. | |
| 6,865,366 | B2 | 3/2005 | Katayanagi et al. | |
| 6,898,410 | B2 | 5/2005 | Boss | |
| 7,046,950 | B2 * | 5/2006 | Fuma et al. | 399/329 |
| 2006/0120778 | A1 * | 6/2006 | Aze et al. | 399/328 |

FOREIGN PATENT DOCUMENTS

| | | |
|---|---|---|
| JP | 5150679 | 6/1993 |
| JP | 5210325 | 8/1993 |
| JP | 6308856 | 11/1994 |

* cited by examiner

FUSING SYSTEM INCLUDING A BACKUP BELT ASSEMBLY

CROSS REFERENCE TO RELATED APPLICATION

The present application is ralated to U.S. patent application Ser. No. 11/234,354, entitled "A FUSING SYSTEM INCLUDING A TENSIONED BELT WITH CROWNED ROLLER" which is filed concurrently herewith and hereby incorporated by reference herein.

BACKGROUND OF THE INVENTION

1. Field of the Invention

The present invention relates to an electrophotographic image forming apparatus, and more particularly to a backup belt assembly for use in a fusing system of such an apparatus.

2. Description of Related Art

In an electrophotographic image forming apparatus, such as a printer or copier, a latent image is formed on a light sensitive drum and developed with toner. The toner image is then transferred onto media, such as a sheet of paper, and is subsequently passed through a fuser assembly where heat and pressure are applied to melt and adhere the unfused toner to the surface of the media. There are a variety of devices to apply heat and pressure to the media such as radiant fusing, convection fusing, and contact fusing. Contact fusing is the typical approach of choice for a variety of reasons including cost, speed and reliability. Contact fusing systems themselves can be implemented in a variety of manners. For example, a roll fusing system consists of a fuser roll and a backup roll in contact with one another so as to form a nip therebetween, which is under a specified pressure. A heat source is associated with the fuser roll, backup roll, or both rolls in order to raise the temperature of the rolls to a temperature capable of adhering unfixed toner to a medium. As the medium passes through the nip, the toner is adhered to the medium via the pressure between the rolls and the heat resident in the fusing region (nip). As speed requirements demanded from fusing systems are increased, the size of the fuser and backup rolls must be increased, and the capability of the heat source must be expanded to sustain a sufficient level of energy necessary to adhere the toner to the medium in compensation for the shorter amount of time that the medium is in the nip. This in turn can lead to higher cost, and large rolls.

As an alternative to the roll fusing system, a belt fusing system can be used. The traditional belt fusing system consists of a single fuser roll and a backup belt that is pressed into contact with the fuser roll. A heat source may be provided within the fuser roll to generate sufficient heat within the system to adhere unfixed toner to a medium as the medium is passed between the fuser roll and the belt.

U.S. Pat. No. 5,359,401 discloses a thermal fixing roller and an endless backup belt. The belt is wrapped about four steel rollers. Because of the location of the four steel rollers, it is believed that the overall size of the fuser system is large, which is disadvantageous. U.S. Pat. No. 5,621,512 discloses a spring-biased pad for forcing a belt against a hot roll. It is believed that this design is disadvantageous due to the friction resulting from the pad making contact with the belt.

Accordingly, alternative designs of fuser systems including backup belts are desired.

SUMMARY OF THE INVENTION

In accordance with a first aspect of the present invention, a system is provided for fusing an unfixed toner image to a substrate comprising a rotatable hot fusing roll and a backup belt assembly. The belt assembly may comprise a backup belt and a housing structure including a nip forming pressure roll. The backup belt may be wrapped about the housing structure including the nip forming pressure roll. Preferably, the pressure roll applies a force to the belt so as to form the sole nip region between the rotatable fusing roll and the backup belt.

The nip forming pressure roll may have a diameter which is equal to about 0.25 to 0.5 times the diameter of the fusing roll and preferably about 0.33 times the diameter of the fusing roll.

The housing structure may comprise a support element positioned upstream of the nip region and located so as to position at least a portion of the belt extending between the pressure roll and the support element near the hot roll. The support element may comprise a rotatable support roll or a non-rotatable support structure.

The housing structure may additionally comprise a housing base, a reinforcement structure coupled to the base, and at least one end cap coupled to the housing base and the reinforcement structure. The housing structure may also comprise at least one tension pad associated with the reinforcement structure.

The backup belt may comprise a polyimide member having a release coating on an outer surface thereof.

The hot fusing roll preferably comprises a steel core having a thickness less than about 0.75 mm, a rubber layer provided over the core and a release layer provided over the rubber layer. The hot fusing roll may further comprise a heating element provided within the core.

In accordance with a second aspect of the present invention, a system is provided for fusing an unfixed toner image to a substrate comprising a rotatable hot fusing roll, and a backup belt assembly. The backup belt assembly may comprise a backup belt and a housing structure including a support element and a rotatable nip forming pressure roll. The backup belt may be wrapped about the housing structure including the support element and the nip forming pressure roll. The pressure roll may apply a force to the belt so as to form a nip region between the rotatable fusing roll and the backup belt. The support element is preferably positioned upstream of the nip region and supports the belt without increasing a length of the nip region between the hot roll and the belt in a process direction.

The support element is preferably located so as to position at least a portion of the belt extending between the pressure roll and the support element near the hot roll without the belt making direct contact with the hot roll until the belt enters the nip region where the belt engages the hot roll just above the nip forming pressure roll, thereby defining a preheat zone.

DETAILED DESCRIPTION

Figure 1:
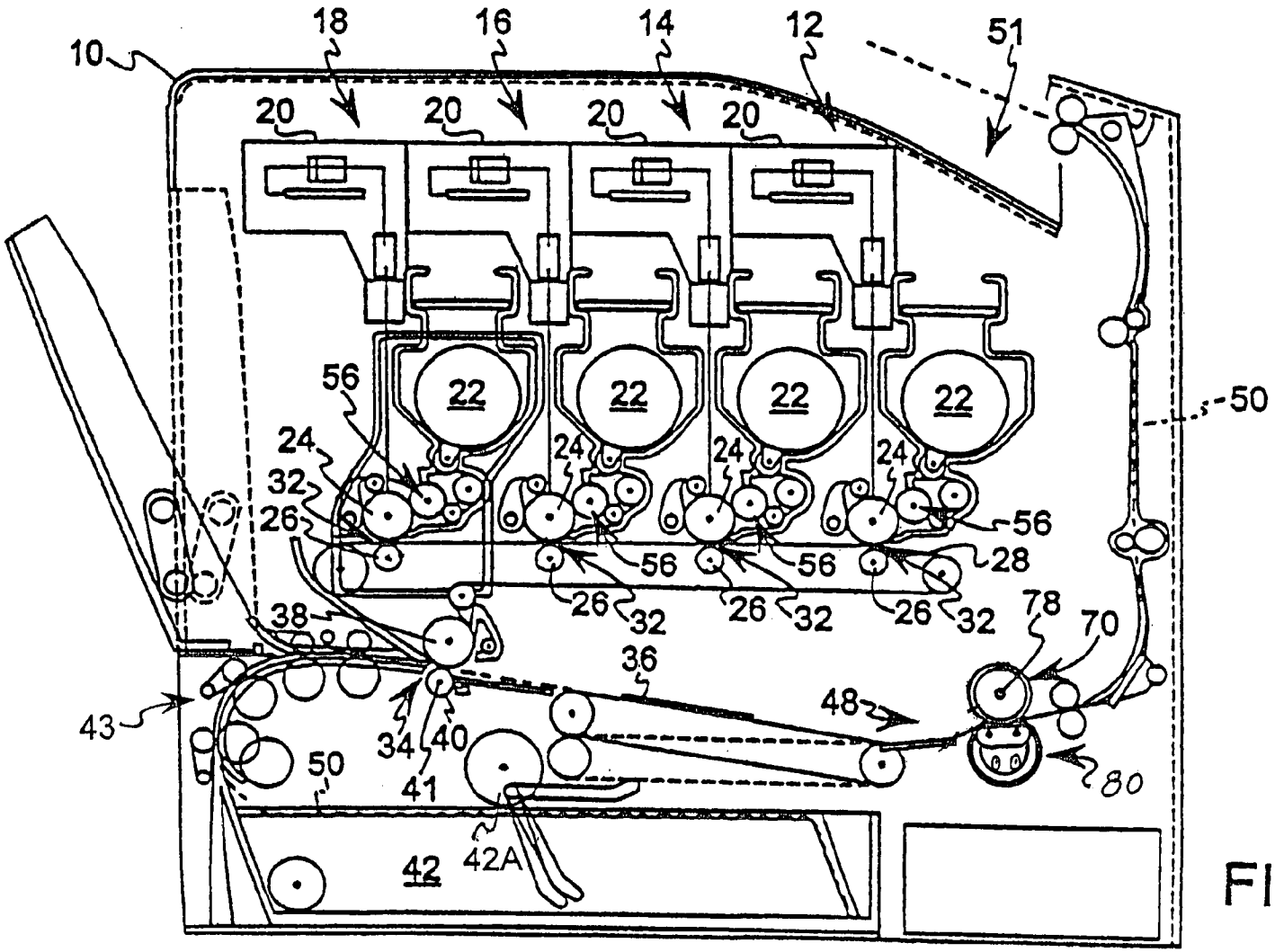
FIG. 1 is a schematic illustration of an electrophotographic printer in which a fuser assembly of the present invention may be incorporated.

Referring to FIG. 1, a color electrophotographic (EP) printer 10 is illustrated including four image forming stations 12, 14, 16, 18 for creating yellow (Y), cyan (C), magenta (M) and black (K) toner images. Each image forming station 12, 14, 16 and 18 includes a laser printhead 20, a toner supply 22 and a developing assembly 56. Each image forming station 12, 14, 16 and 18 also includes a rotatable photoconductive (PC) drum 24. A uniform charge is provided on each PC drum 24, which is selectively dissipated by a scanning laser beam generated by a corresponding printhead 20, such that a latent image is formed on the PC drum 24. The latent image is then developed during an image development process via a corresponding toner supply 22 and developing assembly 56, in which electrically charged toner particles adhere to the discharged areas on the PC drum 24 to form a toned image thereon. An electrically biased transfer roller 26 opposes each PC drum 24. An intermediate transfer member (ITM) belt 28 travels in an endless loop and passes through a nip defined between each PC drum 24 and a corresponding transfer roller 26. The toner image developed on each PC drum 24 is transferred during a first transfer operation to the ITM belt 28 by an electrically biased roller transfer operation. The four PC drums 24 and corresponding transfer rollers 26 constitute first image transfer stations 32.

At a second image transfer station 34, a composite toner image, i.e., the yellow (Y), cyan (C), magenta (M) and black (K) toner images combined, is transferred from the ITM belt 28 to a substrate 36. The second image transfer station 34 includes a backup roller 38, on the inside of the ITM belt 28, and a transfer roller 40, positioned opposite the backup roller 38. Substrates 36, such as paper, cardstock, labels, envelopes or transparencies, are fed from a substrate supply 42 to the second image transfer station 34 so as to be in registration with the composite toner image on the ITM belt 28. Structure for conveying substrates from the supply 42 to the second image transfer station 34 may comprise a pick mechanism 42A that draws a top sheet from the supply 42 and a speed compensation assembly 43, see U.S. patent application Ser. No. 11/234,363, entitled Electrophotographic Device Capable of Performing an Imaging Operation and a Fusing Operation at Different Speeds, filed concurrently herewith, assigned, as well as U.S. Pat. No. 6,370,354 B1, the disclosures of which are incorporated herein by reference. The composite image is then transferred from the ITM belt 28 to the substrate 36. Thereafter, the toned substrate 36 passes through a fuser assembly 48, where the toner image is fused to the substrate 36. The substrate 36 including the fused toner image continues along a paper path 50 until it exits the printer 10 into an exit tray 51.

The paper path 50 taken by the substrates 36 in the printer 10 is illustrated schematically by a dot-dashed line in FIG. 1. It will be appreciated that other printer configurations having different paper paths may be used. Further, one or more additional media supplies or trays, including manually fed media trays, may be provided.

Figure 2A:
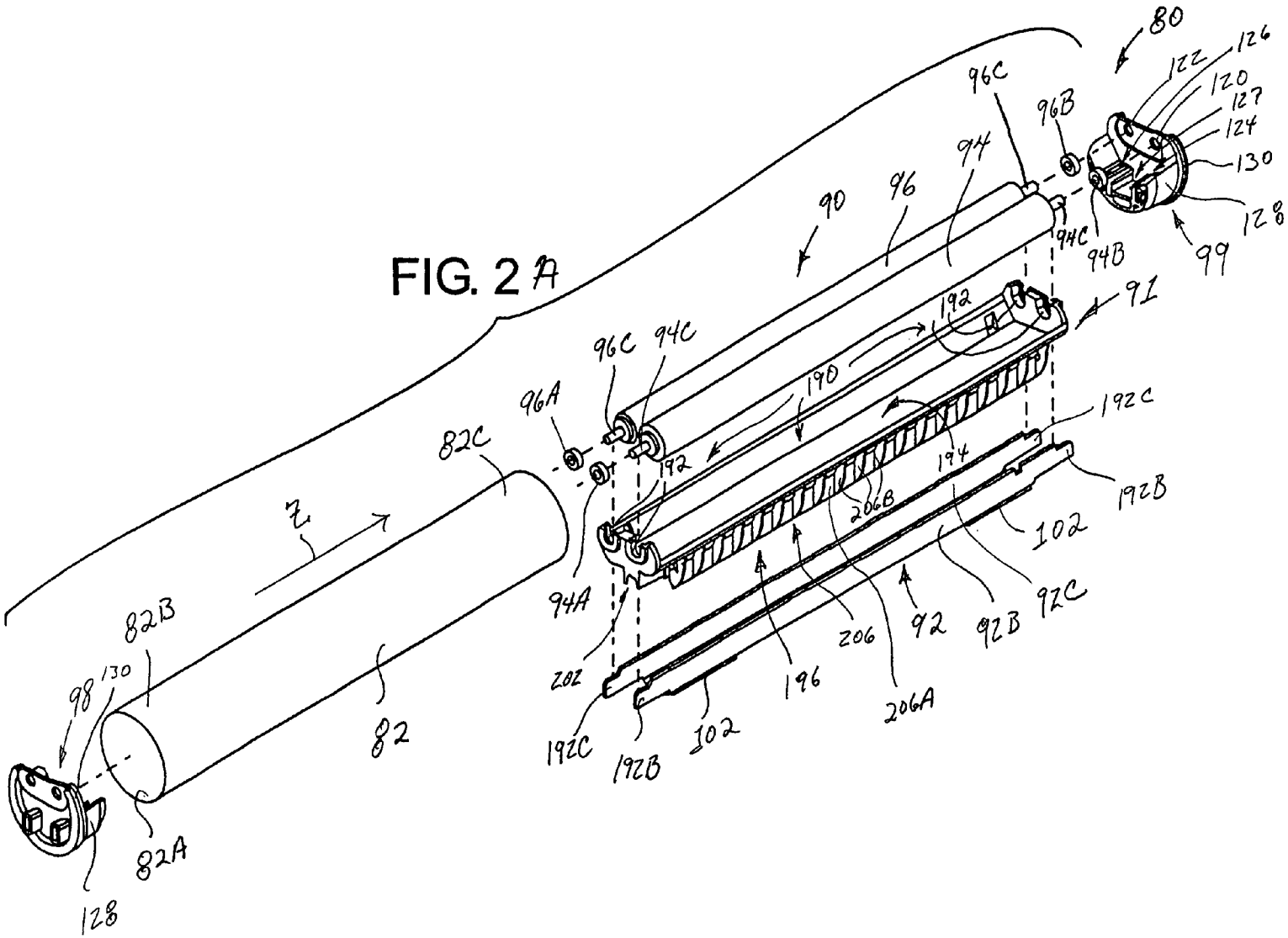
FIG. 2A is an exploded view of the backup belt assembly of FIG. 1.
Figure 2B:
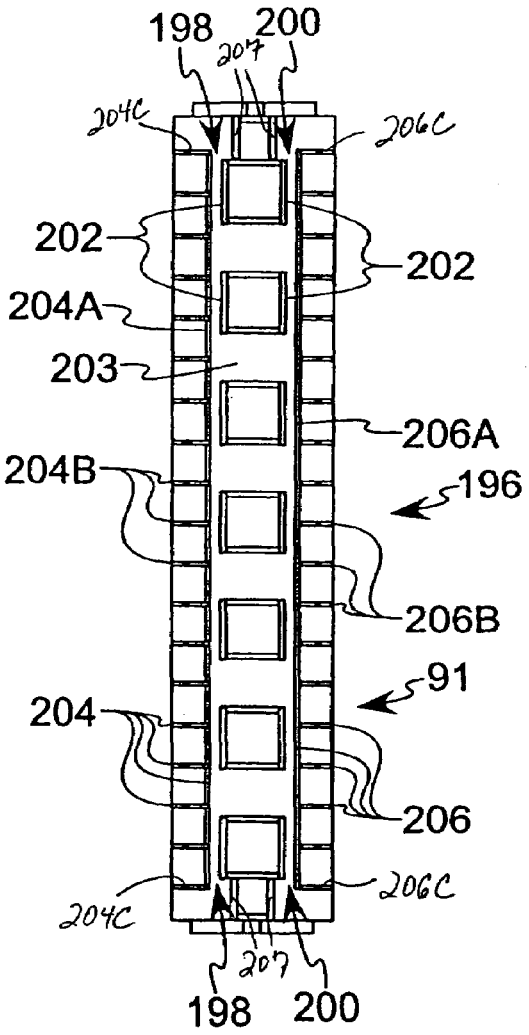
FIG. 2B is a view of the lower portion of the housing base forming part of the backup belt assembly of FIG. 1.
Figure 2C:
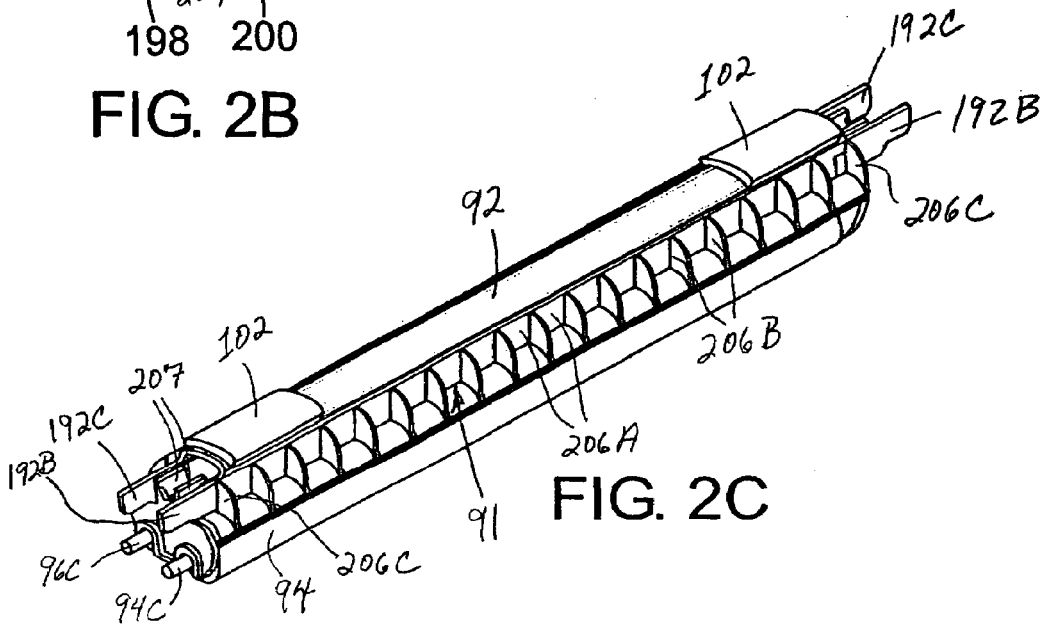
FIG. 2C is a perspective view of the underside of the housing structure forming part of the backup belt assembly of FIG. 1.
Figures 2, 3:
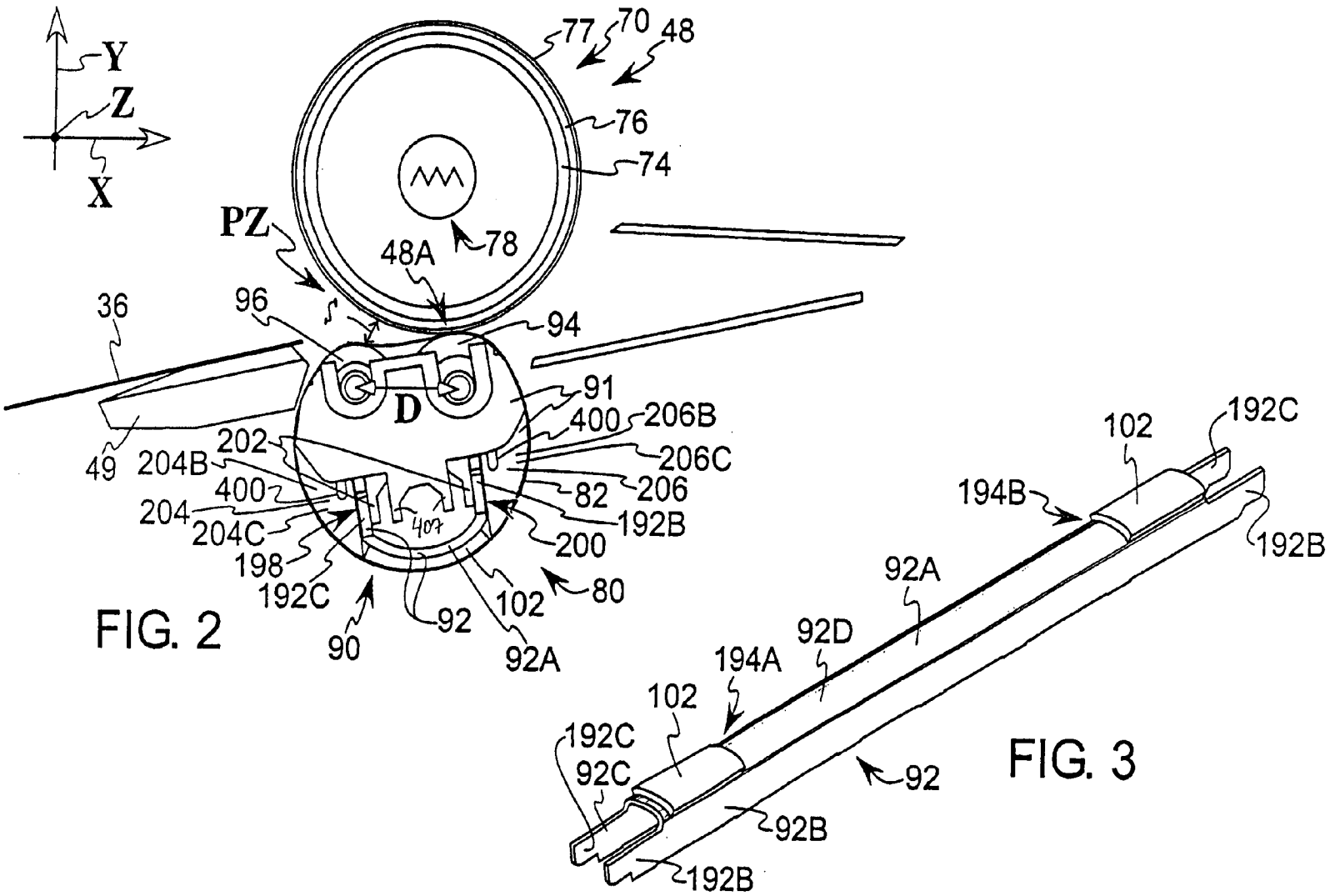
FIG. 2 is a side view of the fuser assembly illustrated in FIG. 1, with an end cap of the backup belt assembly removed.
FIG. 3 is a perspective view of reinforcement structure forming part of the backup belt assembly of FIG. 1.

The fuser assembly 48 in the illustrated embodiment includes a fuser hot roll 70 or fusing roll defining a heating member, and a backup belt assembly 80 cooperating with the hot roll 70 to define a preheat zone PZ and a nip region 48A through which substrates 36 pass so as to fuse toner material to the substrates 36, see FIGS. 1 and 2. A media entry guide 49 is provided just prior to the fuser assembly 48 for guiding substrates 36 into the preheat zone PZ and nip region 48A.

The hot roll 70 may comprise a hollow metal core member 74 comprising, for example, a steel hollow metal core having a thickness of from about 0.4 mm to about 0.75 mm and, preferably, about 0.6 mm, see FIG. 2. The core member 74 may have a length in a scan direction, i.e., in a Z direction in FIGS. 2 and 2A, of from about 230 mm to about 250 mm and, preferably, about 240 mm. The core member 74 may be covered with a thermally conductive elastomeric material layer 76, such as a thermally conductive silicone rubber. The hot roll 70 may also include a PFA (polyperfluoroalkoxy-tetrafluoroethylene) sleeve 77 around its elastomeric material layer 76. The elastomeric material layer 76 may have a thickness of about 1.5 mm and the sleeve may have a thickness of about 50 microns. The outer diameter of the hot roll 70 may comprise about 40 mm to about 50 mm and preferably is about 46 mm. It is contemplated that the hot roll 70 may have a substantially straight shape (the ends of the roll 70 have a diameter which is substantially equal to the diameter at a center of the roll 70) in a longitudinal direction, i.e., in the scan or Z direction. Alternatively, the hot roll 70 may have a saddle shape (the ends of the roll 70 have a diameter which is greater than a diameter at the center of the roll) along its outer surface in the longitudinal direction.

A heater element 78, such as a halogen tungsten-filament heater, may be located inside the core member 74 of the hot roll 70 for providing heat energy to the hot roll 70 under control of a print engine controller or processor (not shown). It should be understood that the present invention is not limited to a particular mechanism or structure for heating the hot roll 70 and that any known means of heating a roll may be implemented within the scope of this invention.

The backup belt assembly 80 may comprise a housing structure 90 and an endless belt 82 positioned about the housing structure 90. The belt 82 may comprise a polyimide inner member having a thickness of about 90 microns and an outer release coating or layer, such as a spray coated PFA layer having a thickness of about 30 microns, or a dip-coated PTFE (polytetrafluoroethylene)/PFA blend layer having a thickness of about 15 microns. The release coating or layer is preferably provided on an outer surface of the polyimide inner member so as to contact substrates 36 passing between the hot roll 70 and the backup belt assembly 80.

The housing structure 90 may comprise a housing base 91, a reinforcement structure 92, a nip forming pressure roll 94, a rotatable support roll 96, first and second end caps 98 and 99 and first and second tension pads 102. The housing base 91 is formed from a polymeric material such as glass and mineral filled polyphenylene sulfide (PPS). The housing base 91 comprises a top or upper portion 190 comprising four outer recesses 192 for receiving four bearings 94A, 94B, 96A and 96B and a center recess 194 for receiving the pressure and support rolls 94 and 96, see FIG. 2A. Each bearing 94A, 94B receives a shaft member 94C of the pressure roll 94 so as to rotatably mount the pressure roll 94 to the base 91 when the bearings 94A, 94B are mounted in corresponding recesses 192. Likewise, each bearing 96A, 96B receives a shaft member 96C of the support roll 96 so as to rotatably mount the support roll 96 to the base 91 when the bearings 96A, 96B are mounted in corresponding recesses 192.

A lower portion 196 of the base 91 comprises first and second slots 198 and 200 defined between inner walls 202 extending out from a floor portion 203 and wall members 204A and 206A also extending out from the floor portion 203 and forming part of outer sections 204 and 206 of the lower portion 196, see FIGS. 2A and 2B. Each outer section 204 and 206 further comprises a plurality of curved ribs 204B and 206B extending away from the corresponding wall member 204A and 206A, see also FIG. 2C.

The reinforcement structure 92 is formed from a metal, such as steel, and comprises a base part 92A and opposing leg parts 92B and 92C so as to define a generally U shape, see FIG. 3. The leg parts 92B and 92C are received in the slots 198 and 200 provided in the lower portion 196 of the housing base 90, see FIG. 2B and 2C. As is apparent from FIG. 2C, the base part 92A of the reinforcement structure 92 has an outer surface 92D that is slightly curved. When the pressure and support rolls 94 and 96 are mounted to the housing base 91, and the reinforcement structure 92 is mounted to the housing base 91, i.e., the leg parts 92B and 92C are received in the housing base slots 198 and 200, the curved reinforcement structure outer surface 92D, including the first and second tension pads 102 provided on the reinforcement structure base part 92A, the curved ribs 204B and 206B of the housing base 91 and the pressure and support rolls 94 and 96 define a generally cylindrical shape for the housing structure 90 about which the belt 82 is mounted and rotates, see FIG. 2.

The nip forming pressure roll 94 comprises a steel shaft having a diameter of from about 9 mm to about 10 mm and, preferably, about 9.5 mm. The steel shaft of the pressure roll 94 has a length in a scan direction, i.e., in a Z direction in FIG. 2, of from about 220 mm to about 235 mm and, preferably, about 227 mm. The steel shaft of the pressure roll 94 may be covered with a thermally non-conductive elastomeric material layer, such as a silicone rubber. The pressure roll elastomeric material layer may have a thickness of about 2.75 mm. The outer diameter of the pressure roll 94 may comprise about 13 mm to about 17 mm and, preferably, is about 15 mm. It is contemplated that the pressure roll 94 may have a crown shape (the diameter at a center of the roll may be greater than a diameter at the ends of the roll) along the longitudinal direction so as to reduce substrate wrinkling. For example, the pressure roll 94 may have a crown of from about 0.3 mm to about 0.9 mm and, preferably, about 0.5 mm. A crown value of 0.5 mm means that the diameter at the center of the roll 94 is greater than the diameter at the ends of the roll 94 by about 0.5 mm. It is also preferred that the hardness of the pressure roll 94, i.e., as measured at the outer surface of the elastomeric material layer on the steel core, has a value of from about 65 Asker C to about 85 Asker C, and preferably about 75 Asker C. In the illustrated embodiment, a heating element is not associated with the pressure roll 94. Nor is the pressure roll 94 provided, in the illustrated embodiment, with a PFA sleeve.

Because the pressure roll 94 is preferably formed as a crowned roll, the first and second tension pads 102 are positioned on outer portions 194A and 194B of the base part 92A of the reinforcement structure 92 so as to tighten the belt 82 at outer portions 82B and 82C of the belt 82, i.e., to remove slack from the outer portions 82B and 82C of the belt 82 in the scan direction so as to create generally equal belt tension along the entire length of the belt 82 in the scan direction or Z direction, see FIGS. 2A and 3. In the illustrated embodiment, the tension pads 102 are formed from polyester felt, but can be formed from any low friction compressible material. Each tension pad 102 may have a thickness of about 3 mm to about 5 mm and, preferably, about 4 mm, a width in the process or X direction direction from about 6 mm to about 12 mm and, preferably, about 8 mm, and a length in the scan or Z direction of about 10 mm to about 80 mm and, preferably, about 55 mm.

The rotatable support roll 96 comprises a steel shaft having a diameter of from about 12.5 mm to about 14.0 mm and, preferably, about 13.5 mm. The steel shaft of the support roll 96 may have a length in a scan direction, i.e., in a Z direction in FIG. 2, of from about 220 mm to about 235 mm and, preferably, about 227 mm. In the illustrated embodiment, the shaft of the support roll 96 is not covered with an elastomeric material layer. Nor is it provided, in the illustrated embodiment, with a heating element or a PFA sleeve.

Figure 4C:
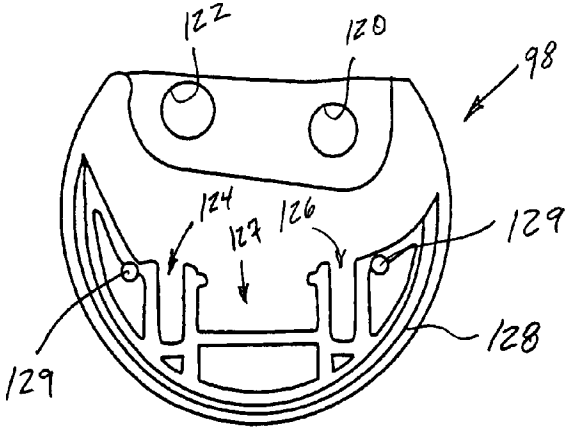
FIG. 4C is an inner side view of the first end cap of the backup belt assembly.
Figure 4D:
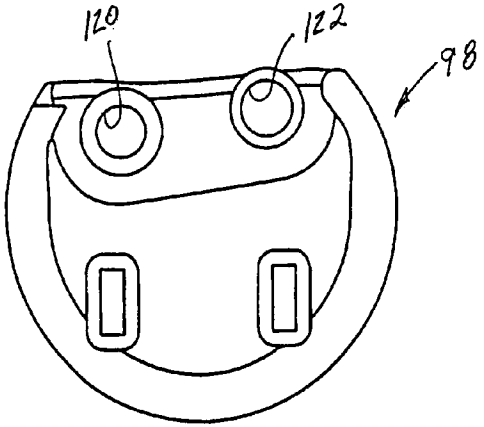
FIG. 4D is an outer side view of the first end cap of the backup belt assembly.
Figure 4A:
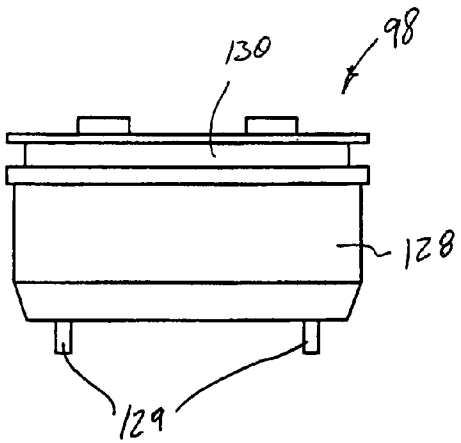
FIG. 4A is a bottom view of the first end cap of the backup belt assembly.
Figure 4B:
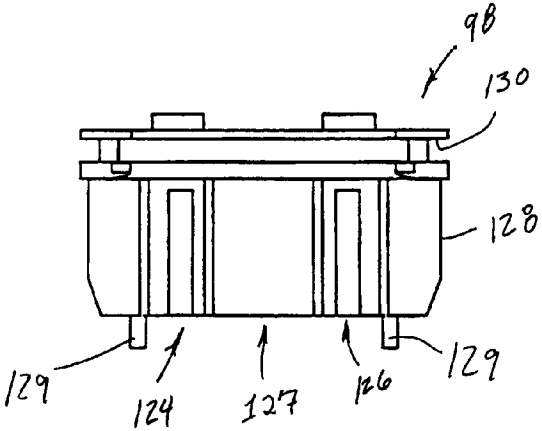
FIG. 4B is a top view of the first end cap of the backup belt assembly.

The first and second end caps 98 and 99 are formed from a polymeric material, such as glass and mineral filled polyphenylene sulfide (PPS). Each end cap 98, 99 is provided with a first bore 120 for receiving a corresponding shaft member 94C of the pressure roll 94 and a second bore 122 for receiving a corresponding shaft member 96C of the support roll 96, see FIGS. 2A and 4A-4D. Each end cap 98, 99 further includes a first outer slot 124 for receiving an end 192B of the reinforcement structure leg part 92B and a second outer slot 126 for receiving an end 192C of the reinforcement structure leg part 92C. A center slot 127 is provided between the outer slots 124 and 126 for receiving walls 207 extending out from the floor portion 203 of the housing base lower portion 196, see FIG. 2B. Each end cap 98, 99 also includes an inner wall 128, which engages a corresponding one of inner end surfaces 82A of the belt 82 and functions as a guide for that belt inner end surface 82A. Locator pins 129 are received in positioning slots 400 provided in a corresponding one of four outer-most ribs 204C and 206C, see FIG. 2, 2B and 4A-4C. An outer recess 130 is provided on each end cap 98 and is adapted to receive a corresponding one of two U-shaped plate-like member, e.g., bellcranks, (not shown) fixedly coupled to a printer frame for holding the end cap 98, 99 in position within the printer frame, see FIGS. 4A and 4B.

The backup belt assembly 80 is assembled by mounting the pressure and support rolls 94 and 96 and bearings 94A, 94B, 96A and 96B to the housing base 91, mounting the reinforcement structure 92 to the housing base 91, and slipping the belt 82 over the combined housing base 91, pressure and support rolls 94 and 96 and the reinforcement structure 92. The first and second end caps 98 and 99 are then mounted to the combined belt 82, housing base 91, pressure and support rolls 94 and 96 and the reinforcement structure 92. The two fixed U-shaped plate-like members (not shown) received in the outer recesses 130 in the end caps 98, 99 maintain the end caps 98 and 99, belt 82, housing base 91, pressure and support rolls 94 and 96 and the reinforcement structure 92 assembled together.

As is apparent from FIG. 2, the nip forming pressure roll 94 functions to bias the belt 82 into engagement with the hot roll 70 such that the belt 82 engages the hot roll 70 in a region positioned just above the pressure roll 94, which region defines the nip region 48A. The support roll 96 is positioned upstream from the pressure roll 94 so as to be spaced from the hot roll 70 and the pressure roll 94. The support roll 96 preferably supports the belt 82 so as not to increase a length of the nip region 48A, i.e., the distance in the process or X direction in FIG. 2 where the belt 82 is in engagement with the hot roll 70. That is, the nip region 48A, defined by the belt 82 biased against the hot roll 70 by the pressure roll 94 and located directly above the pressure roll 94, is preferably the sole nip region or point or points of contact between the belt 82 and the hot roll 70. The nip region 48A may have a length in the process direction of about 5 mm.

It is also preferred that the support roll 96 be located so as to position at least a portion of the belt 82 extending between the pressure roll 94 and the support roll 96 near the hot roll 70 without the belt 82 making direct contact with the hot roll 70 except in the nip region 48A directly above the pressure roll 94. The region prior to the nip region 48A defined by the belt 82 positioned near the hot roll 70 via the support roll 96 defines a preheat zone PZ. The distance D between center axes 294 and 296 of the pressure and support rolls 94 and 96 may be about 15.0 mm to about 16.0 mm and preferably is about 15.5 mm, see FIG. 2. The smallest spacing S between the support roll 96 and the hot roll 70 may be about 0.97 mm.

It is believed that the preheat zone PZ applies energy in the form of heat to a toned substrate 36 prior to the substrate 36 passing through the nip region 48A such that the energy received in the preheat zone PZ by the substrate 36 when combined with the energy received in the nip region 48A results in an effective fusing operation upon the substrate 36.

EXAMPLE

Substrates 36 were passed through a fuser assembly constructed in accordance with the present invention and conventional 60 degree gloss, fusegrade and transparency quality tests were performed on the fused substrates. Similar tests were also performed on substrates that passed through a fuser assembly which lacked a preheat zone PZ, i.e., the belt was removed such that the hot roll engaged directly with the pressure roll. In the fuser assembly without a preheat zone PZ, once the belt was removed, the remaining structure of the backup belt assembly was not modified.

The fuser assembly constructed in accordance with the present invention comprised a hot roll having a steel hollow core having a thickness of about 0.6 mm and a length in a scan direction of about 240 mm. The core was covered with a thermally conductive silicone rubber and included and outer PFA (polyperfluoroalkoxy-tetrafluoroethylene) sleeve. The outer diameter of the hot roll 70 was about 46 mm. The hot roll 70 had a substantially straight shape in its longitudinal direction. A heater element was located inside the core of the hot roll.

The backup belt assembly comprised a housing structure and an endless belt positioned about the housing structure. The belt comprised a polyimide inner member having a thickness of about 90 microns and an outer spray coated PFA layer having a thickness of about 30 microns.

The housing structure was constructed in substantially the same manner as the housing structure 90 set out above. It comprised a nip forming pressure roll comprising a steel shaft having a diameter of about 9.5 mm and a length in a scan direction of about 227 mm. The steel shaft of the pressure roll was covered with a thermally non-conductive elastomeric material layer, such as silicone rubber. The outer diameter of the pressure roll comprised about 15 mm. The pressure roll also had a crown shape with a crown value of 0.5 mm and a hardness value of 75 Asker C. Tension pads were provided on the backup belt assembly reinforcement structure.

The rotatable support roll comprises a steel shaft having a diameter of about 13.5 mm and a length in a scan direction of about 227 mm.

The distance D between center axes of the pressure and support rolls was about 15.5 mm and the smallest spacing S between the support roll and the hot roll was about 0.97 mm.

For the same hot roll temperature, a conventional 60 degree gloss test resulted in a value of 11.3 for a substrate that moved through the fuser assembly without a preheat zone and a value equal to 23.4 for a substrate that moved through the fuser assembly with a preheat zone. The higher gloss test value indicates that more energy was transferred to the substrate that moved through the fuser assembly with the preheat zone than for the substrate that moved through the fuser assembly without the preheat zone. The transparency quality or transmittance was 65% for a transparency that moved through the fuser assembly without the preheat zone and was 75% for a transparency that moved through the fuser assembly with the preheat zone. The higher transmittance percentage indicates that more energy was transferred to the transparency that moved through the fuser assembly with the preheat zone than for the transparency that moved through the fuser assembly without the preheat zone. Fusegrade (a conventional scratch test that is deemed acceptable when a scratch does not remove toner from a fused substrate) was acceptable when the temperature of the hot roll in the fuser assembly without a preheat zone was at 150 degrees and was acceptable when the temperature of the hot roll in the fuser assembly with the preheat zone was 135 degrees. Hence, less energy was required for effecting an acceptable fusing operation for the fuser assembly with the preheat zone.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A system for fusing an unfixed toner image to a substrate comprising:

a rotatable hot fusing roll; and a backup belt assembly comprising a backup belt and a housing structure including a nip forming pressure roll and a support element, said backup belt being wrapped about said housing structure including said nip forming pressure roll and said support element, wherein only said pressure roll applies a force to said belt so as to form a sole nip region where said rotatable fusing roll makes contact with said backup belt, said support element being positioned upstream of said nip region and supporting said belt without increasing a length of said nip region in a process direction and located so as to position at least a portion of said belt extending between said pressure roll and said support element near said hot roll so as to define a preheat zone, wherein a center axis of each of said hot roll and said pressure roll are positioned in generally a same first plane and a second plane extends generally perpendicular to said first plane and passes through said nip region, said support element is incapable of being positioned such that the second plane extends through a center portion of said support element.

2. The system of claim 1, wherein said nip forming pressure roll has a diameter which is less than about 50% of a diameter of the fusing roll.

3. The system of claim 1, wherein said support element comprises a rotatable support roll.

4. The system of claim 1, wherein said housing structure additionally comprises:

a housing base;

a reinforcement structure coupled to said base; and at least one end cap coupled to said housing base and said reinforcement structure.

5. The system of claim 4, wherein said housing structure also comprises at least one tension pad associated with said reinforcement structure.

6. The system of claim 1, wherein said backup belt comprises a polyimide member having a release coating on an outer surface thereof.

7. The system of claim 1, wherein said hot fusing roll comprises a steel core having a thickness less than about 0.75 mm, a rubber layer provided over said core and a release layer provided over the rubber layer.

8. The system of claim 7, wherein the hot fusing roll further comprises a heating element provided within said core.

9. A system for fusing an unfixed toner image to a substrate comprising:

a rotatable hot fusing roll; and a backup belt assembly comprising a backup belt and a housing structure including a support element and a rotatable nip forming pressure roll, said backup belt being wrapped about said housing structure including said support element and said nip forming pressure roll, wherein only said pressure roll applies a force to said belt so as to form a nip region where said rotatable fusing roll makes contact with said backup belt, said support element being positioned upstream of said nip region and supporting said belt without increasing a length of the nip region between said hot roll and said belt in a process direction and located so as to position at least a portion of said belt between said pressure roll and said support element near said hot roll, thereby defining a preheat zone, wherein a center axis of each of said hot roll and said pressure roll are positioned in generally a same first plane, and a second plane extends generally perpendicular to said first plane and passes through said nip region, said support element is incapable of being positioned such that the second plane extends through a center portion of said support element.

10. The system of claim 9, wherein said nip forming pressure roll has a diameter which is less than about 50% of a diameter of the fusing roll.

11. The system of claim 9, wherein said support element comprises a rotatable support roll.

12. The system of claim 11, wherein said nip forming pressure roll comprises a steel core having an elastomeric outer layer and said support roll comprises a stainless steel roll.

13. The system of claim 9, wherein said housing structure additionally comprises:

a housing base;

a reinforcement structure coupled to said base; and at least one end cap coupled to said housing base and said reinforcement structure.

14. The system of claim 13, wherein said housing structure also comprises at least one tension pad associated with said reinforcement structure.

15. The system of claim 9, wherein said backup belt comprises a polyimide member having a release coating on an outer surface thereof.

16. The system of claim 9, wherein said hot fusing roll comprises a steel core having a thickness less than about 0.75 mm, a rubber layer provided over said core and a release layer provided over the rubber layer.

17. The system of claim 16, wherein the hot fusing roll further comprises a heating element provided within said core.

18. The system of claim 9, wherein said nip forming pressure roll does not include a heating element.

19. The system of claim 1, wherein a center axis of each of said support element and said pressure roll are positioned in generally the same plane, wherein said plane does not extend through said hot roll.

20. The system of claim 9, wherein a center axis of each of said support element and said pressure roll are positioned in generally the same plane, wherein said plane does not extend through said hot roll.

* * * * *